United States Patent [19]

Briefer et al.

[11] 4,384,173

[45] May 17, 1983

[54] ELECTROMAGNETIC PLANAR DIAPHRAGM TRANSDUCER

[75] Inventors: Dennis K. Briefer; Michael Flitterman; Richard Silverman, all of Berlin, Mass.

[73] Assignee: Granus Corporation, Marlborough, Mass.

[21] Appl. No.: 174,447

[22] Filed: Aug. 1, 1980

[51] Int. Cl.[3] ..... H04R 9/06

[52] U.S. Cl. ..... 179/115.5 PV

[58] Field of Search ..... 179/115.5 PV

[56] References Cited

U.S. PATENT DOCUMENTS

| | | | |
|---|---|---|---|
| 3,013,905 | 12/1961 | Gamzon et al. | 179/115.5 PV |
| 3,141,071 | 7/1964 | Rich | 179/115.5 PV |
| 3,198,890 | 8/1965 | Rich | 179/115.5 PV |
| 3,690,405 | 9/1972 | Hance | 181/155 |
| 3,919,498 | 11/1975 | Beer | 179/115.5 PV |
| 4,037,061 | 7/1977 | von Recklinghausen | 179/115.5 PV |
| 4,228,327 | 10/1980 | Sawafuji | 179/115.5 PV |
| 4,242,541 | 12/1980 | Ando | 179/115.5 PV |
| 4,276,449 | 6/1981 | Sawafuji | 179/115.5 PV |

FOREIGN PATENT DOCUMENTS

| | | | |
|---|---|---|---|
| 239344 | 8/1964 | Austria | 179/115.5 PV |
| 52-20013 | 2/1977 | Japan | 179/115.5 PV |
| 52-37419 | 3/1977 | Japan | 179/115.5 PV |
| 55-38766 | 3/1980 | Japan | 179/115.5 PV |

*Primary Examiner*—George G. Stellar
*Attorney, Agent, or Firm*—Lahive & Cockfield

[57] ABSTRACT

This invention utilizes an active diaphragm driven directly by the interaction of a constant magnetic field and a time-varying magnetic field produced by current through electrically conducting elements. A magnet assembly, including a plurality of permanent magnets arranged with like poles adjacent to each other, establishes the magnetic field with respect to the conductive elements to provide highly efficient operation.

12 Claims, 4 Drawing Figures

ELECTROMAGNETIC PLANAR DIAPHRAGM TRANSDUCER

BACKGROUND OF THE INVENTION

This invention relates to audio transducers and more particularly to planar electromagnetic loudspeakers.

In the audio transducer field, there are numerous diverse types of sound reproduces. These include, but are not limited to, magnetically driven conical or planar transducers, electrostatically driven planar transducers, foam radiators (driven by electromagnetic force) plasma jet or air ionization devices, and magnetically squeezed pleated metal plate devices. In addition, there are many other transducers that convert audio signals to sound. Planar active diaphragm transducers are generally acknowledged as being the most capable of accurate sound reproduction. However, although accuracy is high for the planar diaphragm transducer, there are other limitations which have not allowed this form of transducer to become commercially feasible.

One form of planar transducer, the electrostatic planar transducer, requires high voltages (which must be provided by special amplifiers or transformers), and is prone to arcing or other malfunctions. Generally, electrostatic planar transducers operating in standard atmosphere cannot produce high sound pressure levels without breakdown. Another prior art form, the electromagnetic planar transducer, is extremely inefficient in that it requires relatively large amounts of power to produce acceptable listening levels.

Accordingly, it is an object of this invention to provide an improved active diaphragm transducer.

It is another object to provide a relatively high efficiency planar diaphragm loudspeaker.

SUMMARY OF THE INVENTION

Briefly, the present invention is an active diaphragm transducer. This transducer includes a frame member which defines a substantially planar central opening, and a substantially planar diaphragm resiliently positioned in that central opening. The diaphragm includes groups of elongated, parallel electrically conductive elements on its surfaces. Those elements are adapted for establishing audio frequency current densities within the respective conductive elements of the groups which have equal magnitude and opposite direction in adjacent groups. In operation, a conventional audio amplifier may be used to establish the audio frequency currents in the conductive elements.

A magnet assembly is affixed to the frame member in a manner provided a constant magnetic field in regions including at least a portion of the groups of electrically conductive elements. The magnetic field in these regions is substantially parallel to the plane of the central opening and perpendicular to the longitudinal axes of the conductive elements. In addition, the magnetic field direction in the various regions is opposite for the respective groups of conductive elements having oppositely directed current densities.

Generally, the magnetic assembly includes at least one set of permanent magnets having linear polar axes, where each set includes at least one magnet associated with each of the groups of conductive elements. The magnetic assembly includes a device for positioning the magnets of each set along a common polar axis perpendicular to the longitudinal axis of the conductive elements, such that each magnet in the set overlies its associated group of conductive elements. The magnetic flux of adjacent magnets in each set is oppositely directed so that adjacent magnets have adjacent like poles. It is this latter factor which provides the high efficiency operation of the present invention. More particularly, with this arrangement, the fields from the adjacent magnets in the various sets interact to shape the field from those magnets to reduce the fringe fields from the magnets. Consequently, the compact magnet assembly provides sufficient magnetic field energy to interact with the time-varying magnetic field generated by the audio current in the conductive elements to provide satisfactory movement of the diaphragm, and in turn satisfactory listening levels for relatively modest input excitation levels. In alternative forms of the invention, the magnetic assembly may include a multiple bar magnet providing a similar magnetic field to that produced by the separate coaxial magnets. In this case, at least one magnetic pole pair is associated with each group of conductive elements.

In various forms of the invention, the conductive elements may all be on one side of the diaphragm, or alternatively, may be on both sides of the diaphragm. The adjacent groups of conductors may be coupled at one end to form U-shaped conductive elements which may be appropriately driven by a voltage across the unconnected ends of the conductors of those groups to establish the audio currents. In various forms of the invention, there may be two or more sets of permanent magnets on same side of the diaphragm, with the various sets being spaced apart in the direction of the longitudinal axes of the conductive elements. In alternate forms, there may be one or more sets of permanent magnets on each side of the diaphragm at corresponding positions. In configurations with magnet sets on both sides of the diaphragm, an optimal arrangement is provided where a plurality of such sets extend at spaced apart locations along each side of the diaphragm, where the magnet sets on one side have correspondingly positioned sets on the other side of the diaphragm.

The magnet assembly may generally include a housing affixed to the frame which extends along the common polar axis of the magnets and encloses the lateral surfaces of the magnets. The housing may in one form of the invention, be electrically conductive, and in another form, be electrically non-conductive. The various individual magnets in the magnet assemblies may be composed of two or more bar magnets aligned along their polar axis, having two like poles adjacent to each other.

The invention may also utilize a baffle plate with acoustically tuned openings which adjust the phasing of the sound waves radiating to a listener from each side of the diaphragm surface. This yields uniform acoustic response over those frequencies whose wavelength is similar to the baffle plate dimension.

This invention provides an audio output of such accuracy that the human ear is incapable of distinguishing between sound from this invention and the original source. At the same time, the invention overcomes the substantial efficiency limitation existent in the prior art planar transducers, either electromagnetic or electrostatic. Such prior art transducers require abnormally large input power to provide just adequate room listening levels. The present invention overcomes this deficiency due to the magnet assembly that allows normal room listening levels to be provided by amplifiers with output ratings that exist in most sound systems.

Another limitation of the prior art planar transducer is relatively poor frequency response at both the extreme low and high limits of the audible spectrum. This invention has overcome these deficiencies. For the high end of the audio range, the uniform response extends to well beyond the human hearing by making the radiating and driven elements one and the same, allowing the diaphragm to be capable of continuing to follow high frequency input signals. Also, this invention shows marked improvement in the bass reproduction by the use of baffle plates that are used in conjunction with the transducer.

As a result, this invention closely approximates a coherent-phase sound source with a fully defined dispersion pattern that is both controllable and directable. This feature, coupled with the lack of separate radiating surfaces for each portion of the audio range, when used in a stereo pair, provides superior sound source placement, or stereo imaging.

Altogether, this invention provides a relatively low cost sound transducer which is able to reproduce sound with a high degree of accuracy, capable of covering the entire audio range without coloration, bipolar in radiating characteristics, capable of excellent "depth" when used as a stereo pair, and sufficiently rugged as to be usable in most situations where other transducers might be prone to failure.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
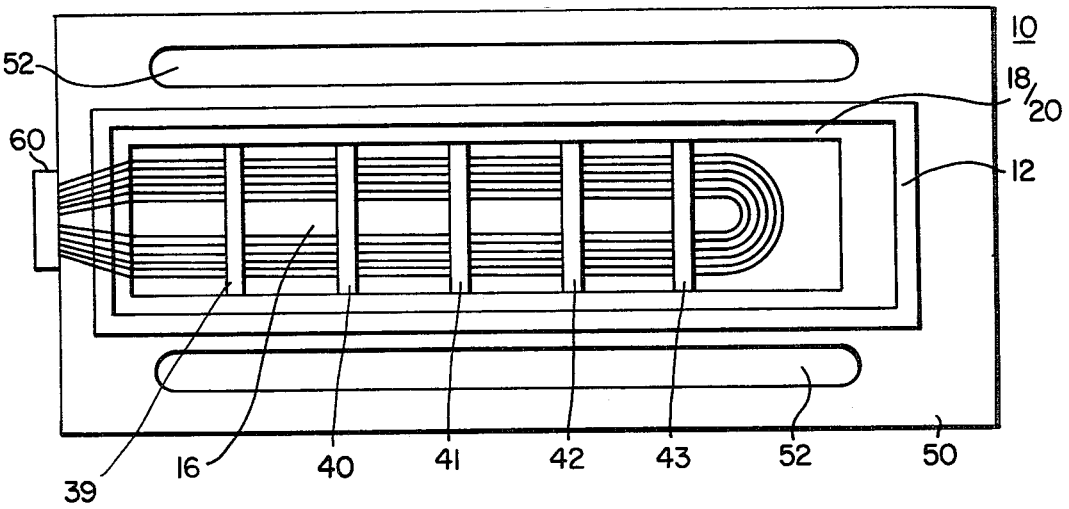
FIG. 1 shows a plan view of an exemplary embodiment of the present invention.
Figure 2:
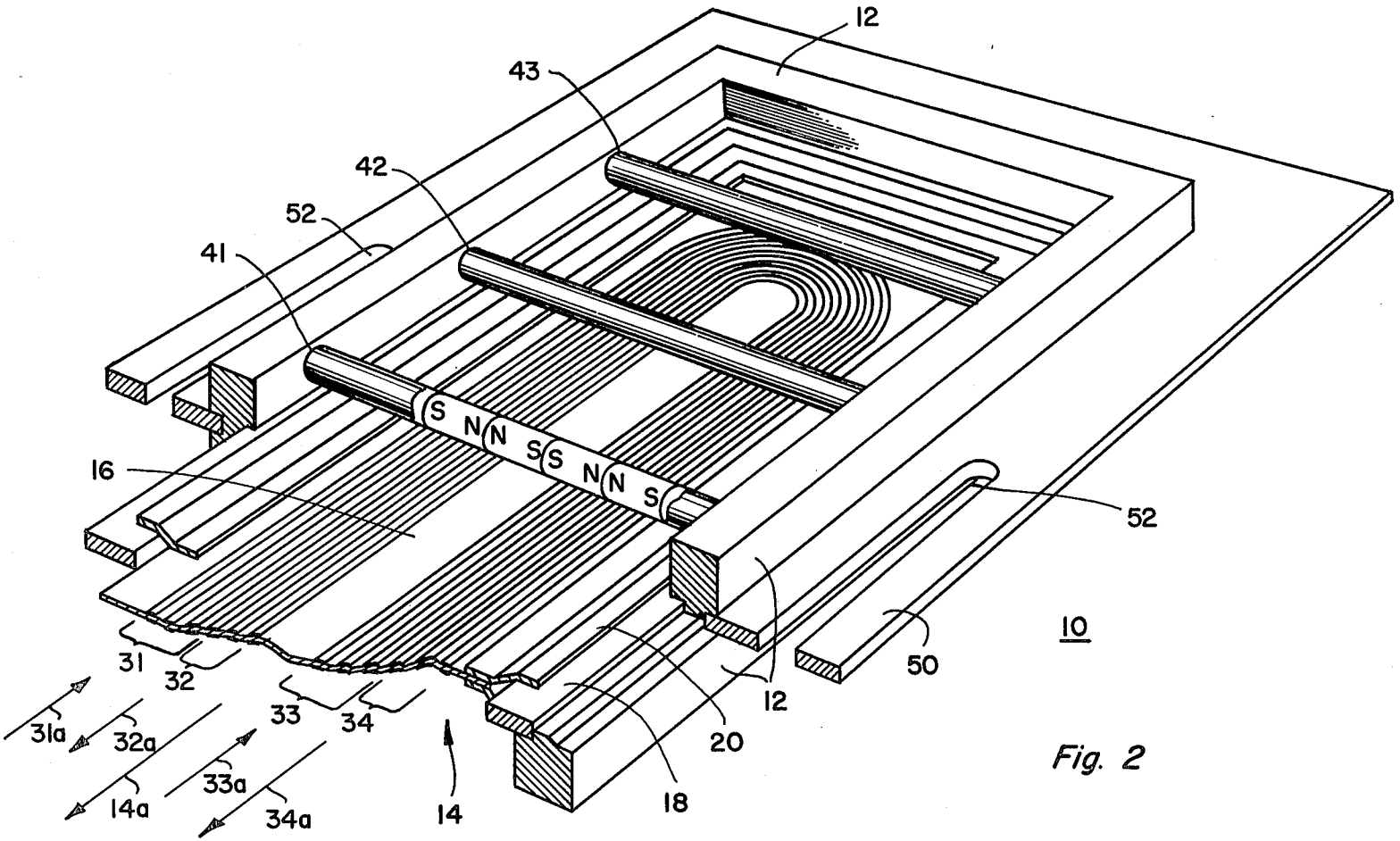
FIG. 2 shows a cutaway perspective view of a portion of the embodiment of FIG. 1.

FIGS. 1 and 2 show a transducer, or loudspeaker, 10 in accordance with the present invention. In those figures, a frame member 12 defines a planar central opening, indicated generally by reference designation 14 in FIG. 2. A reference axis 14*a* in the plane of opening 14 is shown in FIG. 2.

A coupler resiliently positions a planar diaphragm member 16, having two opposed planar surfaces, within the central opening 14. In alternate embodiments, the diaphragm may deviate slightly from the planar configuration of FIG. 1. For example, in an embodiment having a 5 inch by 46 inch diaphragm, the cross section of the diaphragm along its longer dimension may define a ten degree arc and still fall within the scope of "substantially planar" as used herein. In such embodiments, the frame member 12 may define a similarly curved central opening, and axis 14*a* is similarly curved. The diaphragm may also be slightly curved along its shorter dimension. The coupler comprises a peripheral suspension member 18 and a flexible resilient, non-porous elastic film or sheet material 20. The sheet material 20 is connected at one edge to the diaphragm 16 and at the other edge to the suspension member 18. The suspension member 18 is coupled to the frame member 12 mechanically, for example, clamped, stapled or glued. By way of example, the suspension member 18 may be an elastic film or sheet material such as neoprene foam, that has a thickness in the range from 1 mil (0.001 inches) to 75 mils (0.075 inches). This suspension member 18 may be connected directly to the frame member 12 by means of an adhesive, mechanical fastener or fusion of the two materials. The sheet material 20 may be, for example, a flexible, resilient non-porous substance such as an adhesive sheet or contact cement. With this configuration, the connection between the diaphragm 16 and the suspension member 18 is by way of a flexible and low mass joint.

In the present embodiment, the frame member 12 is a stiff non-porous structural member, for example, wood, metal, or plastic. The frame 12 has sufficient rigidity to maintain the suspension 18 fixed in the plane of the central opening 14, i.e. fixed with respect to the frame 12.

Figure 3:
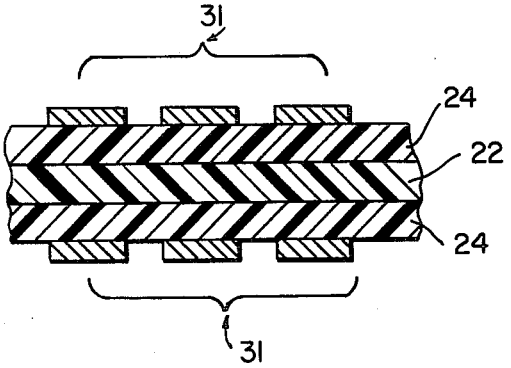
FIG. 3 shows a sectional view of a portion of the diaphragm of the embodiment of FIGS. 1 and 2.

In the present embodiment, the diaphragm 16 includes a plurality of layers, as shown in FIG. 3. The substrate 22 of diaphragm 16 is a non-porous, electrically insulating, film or sheet material, such as polyester film. The film thickness may range from 0.2 mils (0.0002 inches) to 5 mils (0.005 inches). A viscous elastic damping film or sheet material 24 is positioned on top of substrate 22. Sheet 24 may be an adhesive sheet, such as rubber-based, pressure sensitive film, that has a thickness in the range from 2 mils (0.002 inches) to 5 mils (0.005 inches). A set of electrically conductive elements is affixed to the top of the sheet 24.

In the illustrated embodiment, the substrate 22 includes a viscous elastic sheet 24 on both the top and bottom of that sheet 22. Each of sheets 24 includes groups of aluminum conductive elements affixed thereon. Preferably, the conductive elements cover the major portion of the surface area of diaphragm 16.

The conductive elements may be conventionally deposited, sprayed, laminated or bonded on each side of diaphragm 16. The groups are denoted 31–34, respectively, in FIG. 2. Generally, each of these groups includes six substantially parallel, elongated electrically conductive elements (three on each side of diaphragm 16) extending parallel to the reference axis 14*a*. FIG. 3 shows the conductive elements of group 31. At one end of groups 31–34, the respective conductors of groups 31 and 34 are connected, as are the respective conductors of groups 32 and 33. The sheet 24 provides damping for surface or shear waves which might be generated on diaphragm 16. With this configuration, the diaphragm 16 is well-damped to resist acoustic aberrations, light in weight, flexible and tough.

As shown in FIG. 1, the transducer 10 further includes five magnetic assemblies, denoted 39–43, which are affixed to the frame member 12 on one side of diaphragm 16. The view of FIG. 2 shows only magnet assemblies 41–43. As illustrated, the magnet assemblies 39–43 generally extend along axes perpendicular to the reference axis 14*a*, and displaced from that axis so that the assemblies are above the diaphragm 16 (as shown in FIG. 2). Each of assemblies 39–43 includes an outer housing which encloses a set of four permanent magnets having their polar axes parallel to the axis for their respective magnet assemblies. Each of the four magnets of the respective magnet assemblies overlies one of the groups of conductive elements 31–34. The magnets are arranged so that adjacent magnets have like poles next to each other. This polar arrangement is indicated for assembly 41 in FIG. 2, wherein the housing is shown in cutaway form and the North and South poles are marked by N and S, respectively. In alternate embodiments, a multipole magnet provided a similar spatial flux distribution may be utilized in place of one or more of the sets of magnets in the respective magnet assemblies.

With the illustrated configuration, the magnetic fields from the magnets passes through the regions including the conductive elements of the associated respective groups 31–34. These fields are generally oriented in the plane of the central opening 14 and perpendicular to the reference axis 14*a*. Furthermore, the magnetic field through which adjacent ones of groups 31–34 pass are oppositely directed.

With this configuration, relatively high density of magnetic flux is provided in the plane of the central opening while minimizing the undesirable magnetic fringing fields. Consequently, a relatively high flux density and hence, transducer efficiency may be achieved with a relatively large gap (in the direction of axis 14*a*) between adjacent magnet assemblies.

The conductive elements in groups 31–34 may be driven by conventional audio signal generators to establish current densities of equal magnitudes in the conductors of each group, but having oppositely directed current densities, indicated by the respective arrows 31*a*–34*a* in FIG. 2. Generally, the excitation current in the groups 31–34 may be achieved by applying an audio voltage across the respective terminals at a connector 60 of FIG. 1. In other embodiments, there may be differing numbers of groups of conductors. Moreover, the groups may have electrical connections at either end, rather than being U-shaped, as shown in FIGS. 1 and 2. Also a spiral conductor configuration may be used.

With this configuration, during operation the current carrying conductive pattern established by groups 31–34, the magnet field established by the assemblies 39–43 interacts with the field generated by the current passing through the conductive elements. This interaction produced a force on the diaphragm 16 proportional to the current through the conductive pattern and the permanent magnetic field. This force acts perpendicular to the surface of the diaphragm 16 and causes the diaphragm to move, generating acoustic energy.

The magnetic assemblies 39–43, as shown, are comprised of permanent, circular cross-section bar magnets. In other embodiments, different cross-section (such as polygonal or elliptical, or combinations thereof) bar magnets may be used, or alternatively a single multipole magnet may be used. In the preferred embodiment, the magnets of the various magnetic assemblies are made out of ferrite, alnico, rare earth (samerium-cobalt), synthetic material or other known sources of magnetic fields. In various embodiments, each of the magnets may include two or more bar magnets aligned with opposite poles adjacent to each other.

The preferred low cost magnetic assemblies of the present invention use readily available cylindrical magnetic materials. In this case, the magnetic supports or housings may be, for example, a non-ferrous tube, or other geometrical shape which will adequately support and retain and position the magnets. Alternatively, the magnetic housings could be fabricated from the electrically conductive materials, such as copper or aluminum, or electrically non-conductive material, such as polyvinyl chloride, using fabrication processes, such as extruding, molding, casting. These housing members must be sufficiently rigid to resist mechanical forces on the magnets during the transducer operation, and also be displaced from the diaphragm 16 to permit free and non-interfering movement of the diaphragm 16. In the preferred embodiment, the housings for assemblies 39–43 are electrically conductive so as to prevent demagnetization by using eddy current conduction. In cases where the individual magnets of a magnet assembly are glued together, or where a single multipole magnet is used for a magnet assembly, that magnet assembly may be self-supporting and no housing is necessary.

In the present embodiment, additional magnet assemblies corresponding to assemblies 39–43 are similarly positioned on the other side of diaphragm 16, affixed to the frame 12.

FIG. 1 also shows a baffle member 50 which extends about the frame member 12. The baffle member 50 includes a set of openings 52 which are tuned to adjust the phasing of the sound waves radiating from each side of the diaphragm 16, to provide uniform acoustic response over those frequencies whose wavelength is similar to the baffle plate dimension. The openings 52 provide an alternate path for the sound which diffracts around the edge from the back of diaphragm 16. As shown, openings 52 are elongated slots. In alternate forms, the openings may have other shapes, e.g. circles, or the openings may take the form of a porous material.

Figure 4:
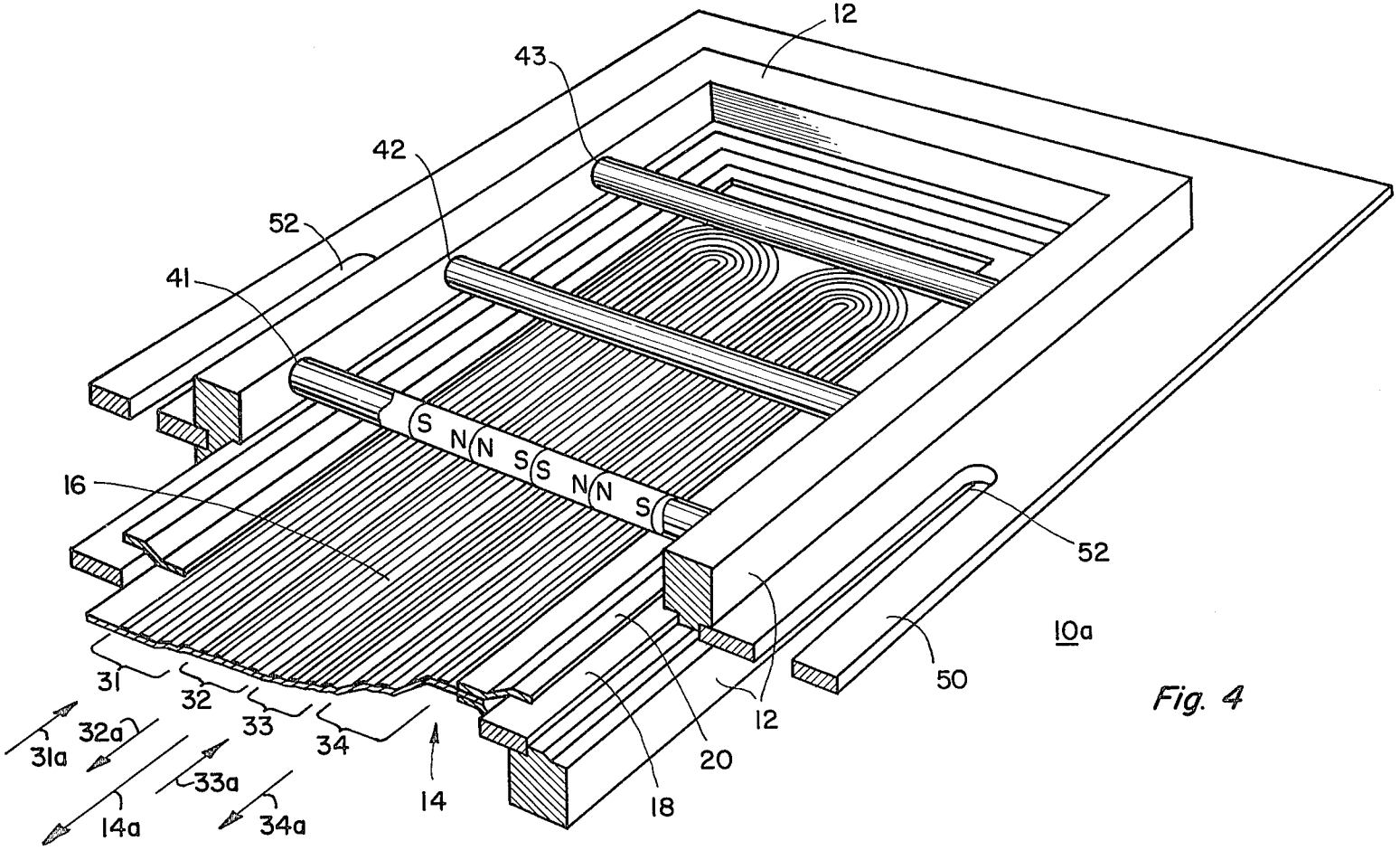
FIG. 4 shows a cutaway perspective view of a portion of another embodiment of the present invention.

FIG. 4 shows an alternate embodiment 10*a* which is similar to the embodiment 10 shown in FIGS. 1 and 2. In FIG. 4, elements having corresponding elements in FIG. 2 are identified by the same reference designations.

In FIG. 4, the diaphragm 16 is 5.0 inches wide and 46 inches long. Each of conductor groups 31–34 includes eight conductors (having 100 mil width and 15 mil interconductor spacing) mounted on the top surface of diaphragm 16. The conductors of groups 31–34 form a "double U" and include 42 inch sections which are substantially straight and parallel to axis 14*a*. At their distal ends, the conductors of group 31 are coupled to corresponding conductors of group 32 and the conductors of group 32 are connected to corresponding conductors of group 34. At their proximal end, the conductors of group 32 are connected (not shown) to corresponding conductors in group 33, and the conductors of groups 31 and 34 are connected (not shown) to an audio signal generator (not shown). With this configuration, the general current density distribution indicated by arrows 31*a*–34*a* is achieved.

In the presently described embodiment, there are fifty-six magnet assemblies (only magnetic assemblies 41–43 are shown in FIG. 4), twenty-eight assemblies above diaphragm 16 mounted on 1.5 inch centers, and twenty-eight assemblies below diaphragm 16 mounted on 1.5 inch centers and offset from the magnets above diaphragm 16 by 0.75 inches. The central axis of each magnet assembly is offset from the diaphragm 16 by 0.375 inches. Each of these magnet assemblies includes four coaxial magnets (having the illustrated pole configuration) within a cylindrical copper housing. Each magnet is comprised of a pair of 0.5 inch length, 0.5 inch diameter Ferrite oriented ceramic magnets.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A loudspeaker comprising:

A. frame member defining a substantially planar central opening,

B. A diaphragm member having two opposed substantially planar surfaces, and including at least two groups of substantially parallel, elongated electrically conductive elements extending parallel to a reference axis in the plane of said central opening, C. means for resiliently positioning said diaphragm member within and substantially parallel to the plane of said central opening, D. means for coupling an audio frequency signal to the elements of said groups in a manner establishing equal magnitude, oppositely directed current densities in adjacent ones of said groups, E. field means for establishing constant magnetic fields in a plurality of regions, said fields being substantially parallel to the plane of said central opening and perpendicular to said reference axis, each of said regions being associated with and including at least a portion of one of said groups, wherein the magnetic fields in regions associated with adjacent groups are oppositely directed, wherein said field means includes at least two sets of permanent magnets having substantially linear polar axes, wherein at least two of said sets are positioned on the same side of said diaphragm and spaced apart in the direction of said reference axis, each set including at least one permanent magnet associated with each of said groups of conductive elements, and said field means further includes means for positioning the magnetic pole pairs of the magnets in each set along a common polar axis, said common polar axis being substantially parallel to the plane of said central opening and perpendicular to said reference axis, whereby each permanent magnet overlies its associated group of conductive elements and the magnetic flux from adjacent ones of said permanent magnets of said set is oppositely directed.

2. A loudspeaker according to claim 1 wherein said frame member further includes a baffle member extending in a plane substantially parallel to said diaphragm member and having one or more openings whereby acoustic waves from one side of said diaphragm may pass to the other side.

3. A loudspeaker according to claim 2 wherein said opening is an elongated slot extending parallel to said conductive elements.

4. A loudspeaker according to claim 1 wherein said field means includes at least two of said sets of permanent magnets on each side of said diaphragm, said sets on each side being spaced apart in the direction of said reference axis and underlying a corresponding set on the other side of said diaphragm.

5. A loudspeaker according to claim 1 wherein said permanent magnets are elongated and have end surfaces transverse to said polar axes and lateral surfaces extending substantially in the direction of said polar axes, and wherein said magnet positioning means for each set includes a housing affixed to said frame member and extending along said common polar axes and substantially fully enclosing the lateral surfaces of said magnets.

6. A loudspeaker according to claim 5 wherein said housing is electrically conductive.

7. A loudspeaker according to claim 5 wherein said housing is electrically non-conductive.

8. A loudspeaker according to claim 1 wherein said diaphragm is multi-layered including a non-porous insulating film substrate having a visco-elastic film on at least one surface, said outer visco-elastic film underlying said conductive elements.

9. A loudspeaker according to claim 1 wherein each of said permanent magnets includes two or more adjacent bar permanent magnets having their individual polar axes aligned along said common polar axis and having two opposite poles adjacent to each other.

10. A loudspeaker according to claim 1 wherein the ends of the conductive elements of at least one of said groups are connected to the respective ends of the conductive elements of one of said groups having an oppositely directed current densities, and wherein said coupling means includes means for applying an audio voltage across the unconnected ends of the conductive elements of said groups, whereby said oppositely directed current densities are established by said applied voltage.

11. A loudspeaker according to claim 1 wherein at least one of said sets of permanent magnet is a unitary multiple pole pair magnet.

12. A loudspeaker according to claim 1 wherein said field means includes at least two of said sets of permanent magnets on each side of said diaphragm, said sets on each side being equally spaced apart from adjacent sets in the direction of said reference axis, wherein said sets on one side of said diaphragm are offset from the sets on the other side of said diaphragm in the direction of said reference axis by a distance substantially equal to one-half the distance separating adjacent sets on one side of said diaphragm.

* * * * *